US006662977B2

(12) United States Patent
Gerber et al.

(10) Patent No.: US 6,662,977 B2
(45) Date of Patent: Dec. 16, 2003

(54) MODULAR VALVE ASSEMBLY AND SYSTEM WITH AIRTIGHT, LEAKPROOF AND SHOCKPROOF CLOSURE FOR ENGAGEMENT IN THE NECK OF A CONTAINER

(76) Inventors: Bernard R. Gerber, 583 Mello La., Santa Cruz, CA (US) 95062; Jyotirmay Deb, 1800 W. Mountain St., Glendale, CA (US) 91201

( * ) Notice: Subject to any disclaimer, the term of this patent is extended or adjusted under 35 U.S.C. 154(b) by 75 days.

(21) Appl. No.: 10/100,242

(22) Filed: Mar. 14, 2002

(65) Prior Publication Data

US 2003/0173380 A1 Sep. 18, 2003

(51) Int. Cl.[7] ..... B65D 5/72
(52) U.S. Cl. ..... 222/494
(58) Field of Search ..... 222/494

(56) References Cited

U.S. PATENT DOCUMENTS 5,897,033 A * 4/1999 Okawa et al. ..... 222/212
6,199,725 B1 * 3/2001 Garibaldi ..... 222/207
6,325,253 B1 * 12/2001 Robinson ..... 222/212

* cited by examiner

*Primary Examiner*—Philippe Derakshani
(74) *Attorney, Agent, or Firm*—Michael Hetberington; Woodside Intellectual Property Law Group

(57) ABSTRACT

A modular valve assembly provides an airtight, shockproof, leakproof and evaporation proof closure effective for sealing engagement with the neck or outlet of a flexible or reducible container. The modular valve assembly is effective in preventing: (1) leakage of fluids from the container due to vibration or changes in temperature or pressure; (2) any backflow or reentry of contaminants through the valve assembly, including air; and (3) evaporation of fluid from the container. If the fluid initially is sterile, the closure maintains the sterility of the remaining fluid in the container during and between dispensings of the fluid. Thus, the modular valve assembly extends the useful life of the fluid in the container to its shelf life. Although the user makes many dispensings from it, the container behaves as though she or he had never opened it. Thermostable fluids delivered through this modular valve assembly have no need for preservatives or refrigeration.

11 Claims, 5 Drawing Sheets

MODULAR VALVE ASSEMBLY AND SYSTEM WITH AIRTIGHT, LEAKPROOF AND SHOCKPROOF CLOSURE FOR ENGAGEMENT IN THE NECK OF A CONTAINER

BACKGROUND OF THE INVENTION

The field of the invention relates generally to a valve assembly for one-way flow. In particular, the field of the invention relates to a modular valve assembly for sealing engagement in the neck of a flexible container, forming a closure that is airtight, shockproof, leakproof and evaporation proof. This closure is effective against leakage of fluids due to vibration as well as changes in temperature and pressure, for preventing any backflow or reentry of contaminants through the valve assembly, including air, or evaporation of fluid from the container. Moreover, if the fluid initially is sterile, the shockproof closure maintains the sterility of the remaining fluid in the container during and between dispensings of the fluid.

In dispensing sterile fluids from a container wherein the container has an extended period of use-life, it is important to prevent any back flow of contaminants into the container during and after the dispensing operation has been carried out. Contaminants in the form of materials originating from outside of the valve assembly and container may include microorganisms, atmospheric gases, moisture, dust or the like. If the sterile fluid is contaminated it can affect the quality, concentration of constituents, potency and even safety of the product. In many cases, it is highly desirable to prevent leakage and evaporation of the contents of the container between uses. At best, leakage will cause sanitary problems as well as the loss of some or the entire product. At worst, evaporation of a volatile solvent will alter the concentration of the remaining solute. This could prove dangerous.

If a container of a sterile fluid has a one-time use and the user does not intend to dispense fluid over an extended period, the problem of contaminants flowing backward into the container usually does not exist. In one known liquid handling container disclosed in U.S. Pat. No. 2,715,980 to Frick, the valve mechanism involves a valve body with a central port extending through the valve body and with branch ports extending from the central port to the outside surface of the valve body. An expansible sleeve, such as a sleeve of a rubber-like material, encloses the outside surface of the valve body preventing flow from the branch ports. When a fluid is to be dispensed, it flows through the central port and then through the branch ports causing the sleeve to expand and permitting the fluid to flow out around one end of the sleeve. During such flow, it is possible for contaminants to flow into the expanded end of the sleeve and then through the branch ports and central port, back into the container. An effective blockage of contaminant back flow into the container is not available.

Kulle in U.S. Pat. No. 4,346,704 discloses another valve incorporating an elastic tube or sleeve. A solution is dispensed through a central tube or channel to branch ports, which deliver the fluid to the inside surface of an elastic sleeve or tube. When the fluid is pressurized, it displaces the elastic tube outwardly permitting flow from the branch ports outwardly from the end of the sleeve. The Kulle device is primarily intended for a one-time use, such as in dispensing an anesthetic. There is no particular problem with a return flow of contaminants into a container or leakage of contents from the container because of such one-time use. The Kulle device is intended to deliver anesthetics at high flow rates and low pressures so that accurate dispensing is possible.

However, such conventional valves lack mechanisms for repeatably locking a seal to a container of sterile fluid so that once opened, the container does not need to be refrigerated nor are preservatives required to safeguard the integrity and concentration of the fluid. The majority of compression-type seal applications are static in nature, providing an effective seal only until the container is first opened. This means the components of the seal do not interact to reseal the container against external matter. Once the user opens a container of fluid, the integrity of the fluid degrades and has a limited use life. In addition, there is currently no mechanism for providing a reusable, locking seal for a container of fluid such that the seal is invariantly secure against vibration as well as against changes in temperature and pressure during long term storage and reuse.

Newton et al., U.S. Pat. No. 5,226,568, purports to disclose a resealable valve and cap for preventing backflow of air into a deformable container. However, unintentional compression of the container by dropping or squeezing, or variation in temperature and pressure may enable excursion of fluid to reside between the seal and cap. In addition, this system is not able to compensate for over-pressure of the cap or friction and abrasion applied by the cap against the seal, which ultimately degrades the seal and may open the contents of the deformable container to contamination.

Therefore, what is needed is a closure that provides a repeatable locking seal for a container of fluid, is shockproof, leakproof, contamination proof and evaporation proof; one that is immune to changes in pressure and temperature and is able to maintain the integrity of the fluid by preventing the unwanted passage of matter in either direction between uses. Such a seal would extend the use life of a product essentially to the limit of its shelf life.

The shelf life defined herein is the length of time an unopened product, such as a packaged food, a chemical preparation, or a pharmaceutical product, may be stored without deteriorating and remain effective for use. The use life or useful-life is the length of time after opening the container or package, i.e., its first use, that a product may be used, without deteriorating and remain effective for use. Most fluids are sensitive to contact with the environment and degrade due to hydrolysis, oxidation and microbial attack. In most cases, the use life is considerably shorter than the shelf life. Therefore, what is needed is a container closure that extends a fluid's use life up to its shelf life, a closure that behaves throughout multiple deliveries as if its associated container had never been opened.

SUMMARY OF THE INVENTION

An aspect of the present invention provides a modular valve assembly for effecting a sealing engagement with the neck of a flexible container enabling the easy dispensing of fluid while preventing any leakage, evaporation, or back flow of contaminants, including air and microbes, through the valve assembly into the container holding the remaining fluid. Thermostable fluids delivered through this assembly have no need for preservatives nor require refrigeration. Another aspect of the invention provides a valve assembly that seals to the interior and exterior surfaces of a container over a wide range of tolerances without concern for the presence of flash or other nonconformities on the neck of the container.

An aspect of the invention effects a primary seal on top of a neck of a flexible container. It also effects a secondary seal on the interior surface of the container and a locking seal on the exterior surface or threads of the neck of the flexible container. The flexible container can be a squeeze bottle, a plastic tube, a syringe or piston, a pouch, or a bag. The container also may be a combination two or more of these. For example, the container having flexible walls can enclose a plastic bag wherein the bag attaches to the neck of a container or any other containment vessel. Such vessel is characterized by a compressible or volumetrically reducible reservoir so that flexible walls for applying a pressure will expel or cause a fluid to flow.

The valve assembly comprises a seat in cooperative engagement with a seal, a segmented retainer and a threaded or snap cap. As the cap is seated, the retainer segments close and transmit lateral compressive forces from the closure of the cap to all sealing surfaces of the seal. The geometry of the seat, seal, retainer and cap interact to ensure that residual fluid is forced progressively outward into a recess between the cap and the tip region of the seat. When the cap is in the seated or closed position, the compressive forces provided by the cap against the retainer, seal and seat, respectively provide a shockproof seal of the fluid, which is effective against the ingress or egress of matter at a molecular level, to include even air or volatile solvents. The extent of the seal is such that the valve assembly is immune to variations of pressure and temperature and the container can be accidentally squeezed, dropped or subjected to severe vibration without loss of fluid integrity.

In accordance with an aspect of the present invention, a valve assembly includes an elongated, tapered seat with an elastomeric seal laterally enclosing the outside surface of the seat. The seat defines a fluid flow path through an exit port or orifice located in the side of an upper tapered portion. Pressing the walls of the flexible container activates fluid flow. Fluid passes through the seat through the exit port and into the space between the outside surface of the seat and the elastomeric seal. The seal and seat are configured to create a progressive seal in a reverse direction for the excursion of fluid to prevent fluid from reentering the container. The cooperative engagement of the cap, retainer, seal and seat respectively provide a shockproof sealing closure when the cap is in the seated position.

Another aspect of the invention provides a container neck closure that can be manufactured easily using existing blow molding, injection molding and other molding processes. The components, seat, seal, retainer and cap, are molded separately, assembled, and snap together. These components can be designed to fit conformably over the neck of a container to form a dispensing and delivery system. While the seal functions with precise tolerances and can effect a substantially complete seal of the fluid in the container, the assembly includes a base having an interior and exterior seal for engaging the inner and outer diameter of a container neck. Thus, the assembly can be adapted for variations in tolerances associated with blow molding and high volume production of containers.

The seat is tapered over most of its length, which makes it simple to assemble with the associated seal and retainer. Only about 0.050 cm of seal length is needed to create a reliable barrier. Thus, only a short cylindrical section of the seat is needed to mate conformably against the seal to form an effective barrier. The seal below the exit port is significantly thicker than the portion of the seal above the exit port. This causes any displaced fluids, after closure, to move only toward the aperture at the tip of the seat.

A compressive load provided by the retainer holds down both seal and seat. The retainer has a plurality of segments, typically four to six, outboard of the seal. These segments are displaced inwards toward the seal when a user closes the cap. The tips of the segments further progressively compress the seal above the exit port, preventing backflow. Securing the cap to the retainer compresses the segments of the retainer firmly locking the seal against the seat. This action prevents evaporation or the accidental dispensing of fluid. Alternatively, it is possible to have only a single segment or arm that compresses the exit port area only and thus creates an effective seal.

BRIEF DESCRIPTION OF THE DRAWINGS

These and other features, aspects, and advantages of the present invention will become better understood with regard to the following descriptions, appended claims, and accompanying drawings, in which:

DETAILED DESCRIPTION

Figure 1:
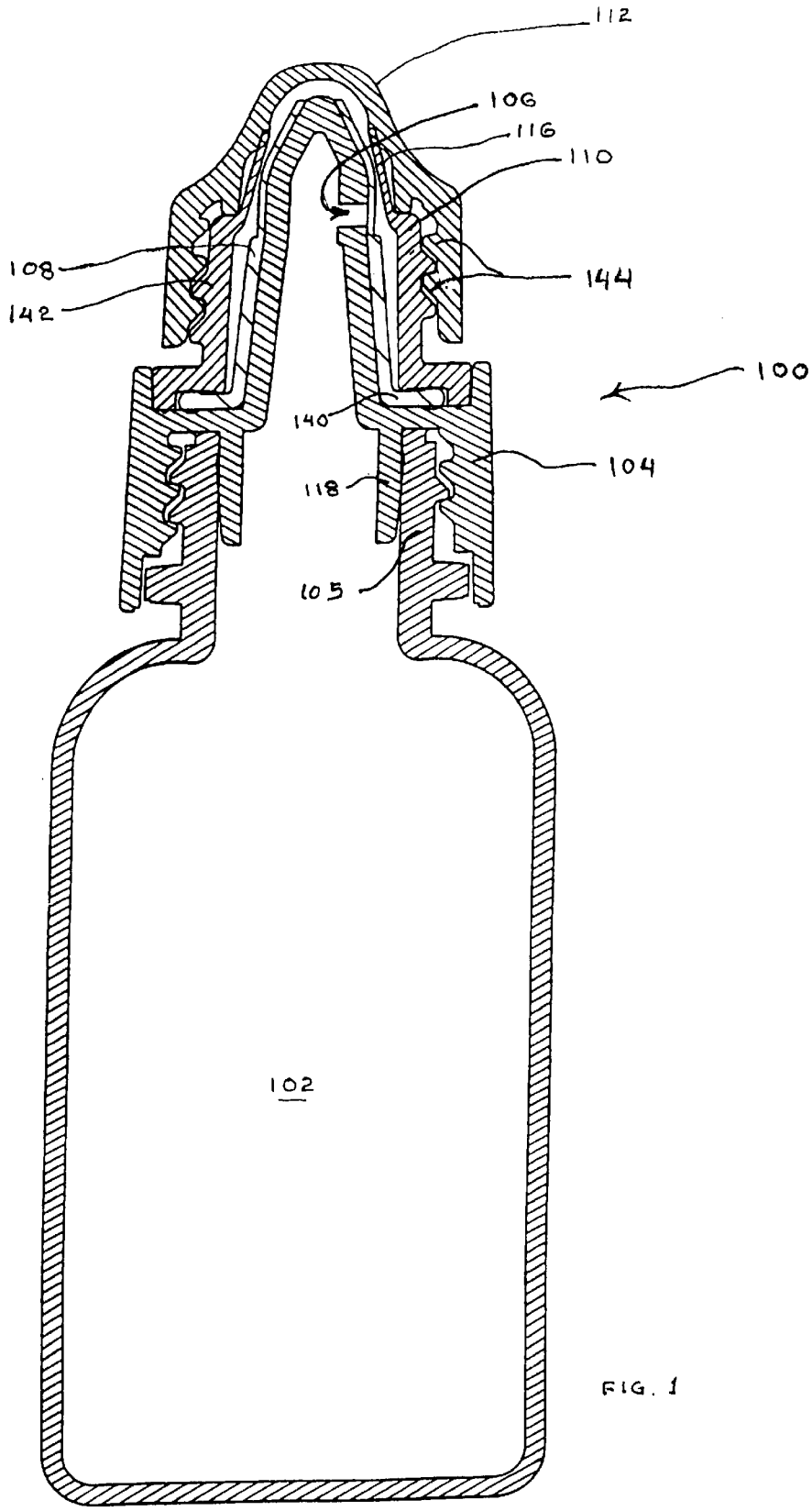
FIG. 1 is a cross-sectional diagram of a modular valve assembly engageably fitted over the neck of a flexible container in accordance with an aspect of the invention.
Figure 2:
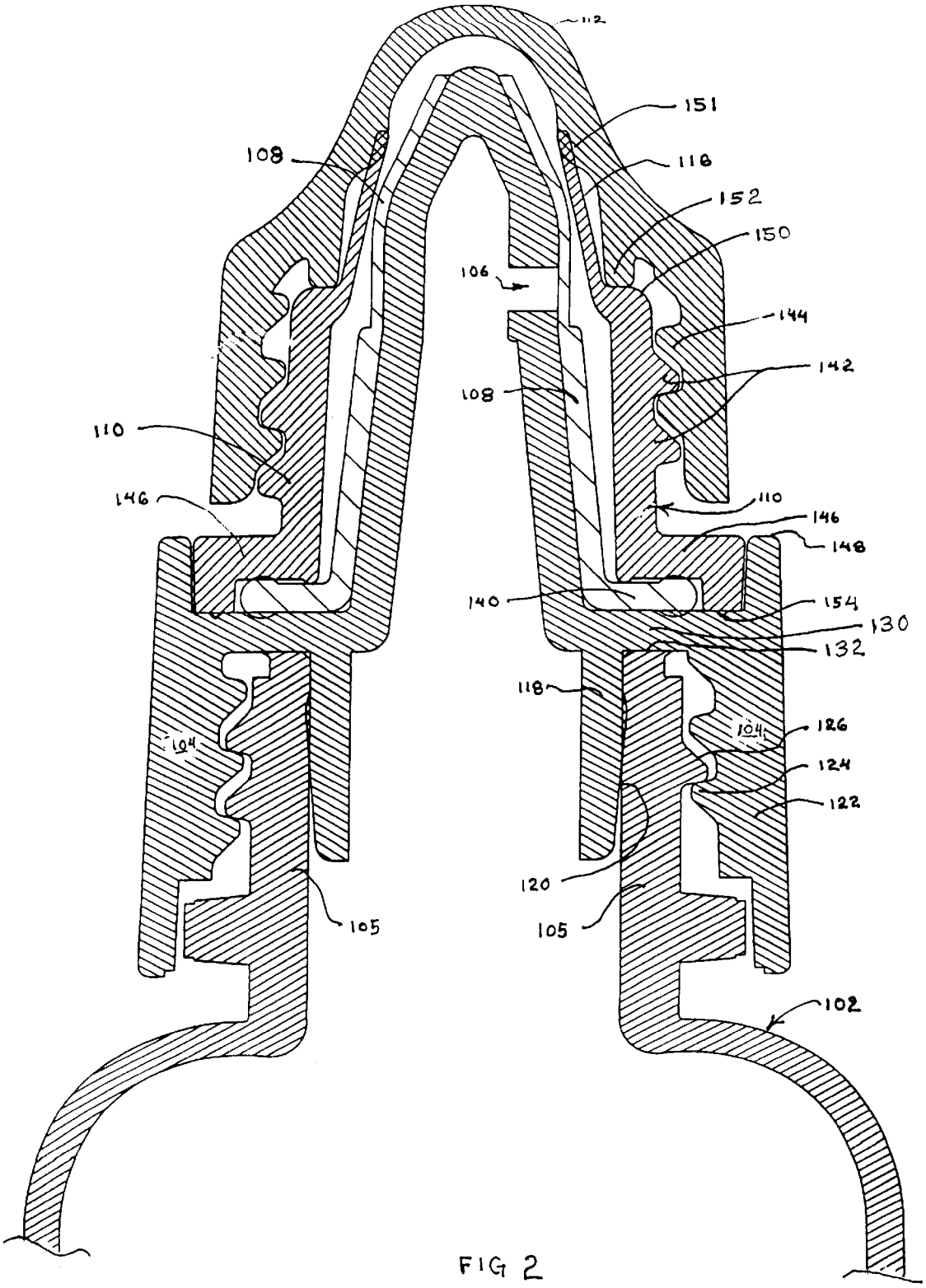
FIG. 2 is an enlarged cross-sectional diagram of the valve assembly and cap showing details of the sealing surfaces.
Figure 4A:
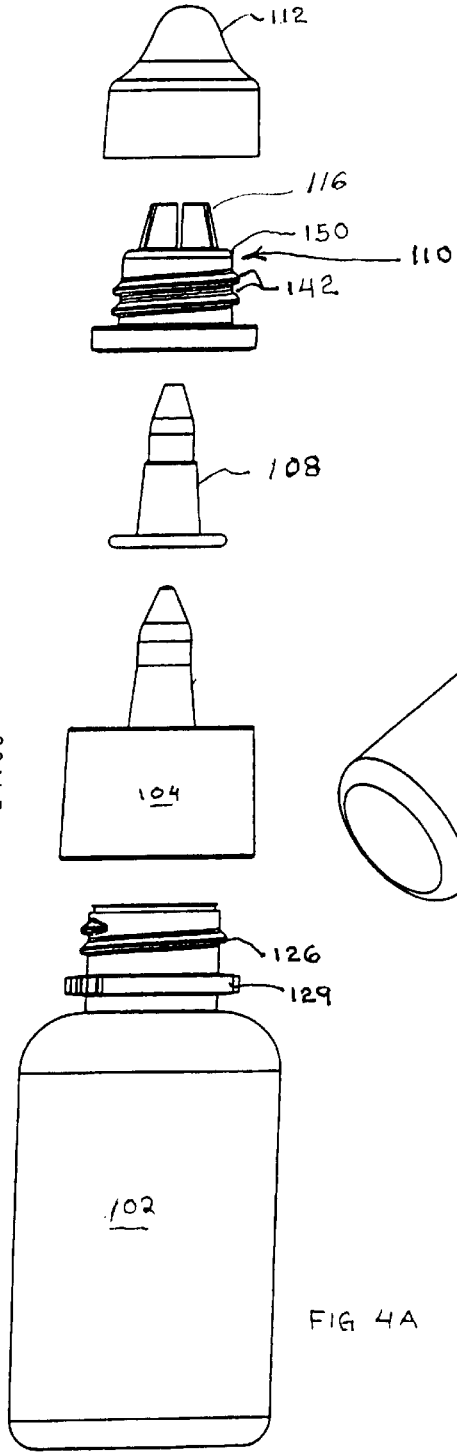
FIG. 4A is a side view of the components of a valve assembly in accordance with an aspect of the invention.

FIG. 1 shows a modular valve assembly 100 affixed to the neck 105 of a container 102. Valve assembly 100 comprises a seat 104 defining a fluid flow path from the container through an exit port 106. The seat 104 is cooperatively engaged with an elastomeric seal 108, which is in turn held in engagement against the seat by a retainer 110. A cap 112 is provided with an engagement means such as a series of threads 114 around its base portion for interengagement with mating threads of the retainer 110. The cap 112 applies compressive forces to the seal 108 through the retainer 110. The retainer has a plurality of segments 116 in its upper portion as shown in FIG. 4A. The retainer preferably has four to six segments outboard of the seal 108. These segments are displaced inwards toward the seal 108 when a user tightens the cap 112 into a seated or closed position. As shown in FIGS. 1 and 2, the segments, 116 of the retainer 110 compress the seal 108 above the exit port 106 and perform two functions. Due to the geometry of the upper portion of the seat 104 above the exit port 106, the tips of the segments circumferentially compress the seal above the exit port preventing fluid from being accidentally dispensed when the cap is secured.

Secondly, the segments of the retainer apply a compressive force to the seal to force excess fluid from the exit port 106 outward progressively toward the distal tip of the seat 104 thereby preventing backflow of fluid into the container 102.

Figure 3:
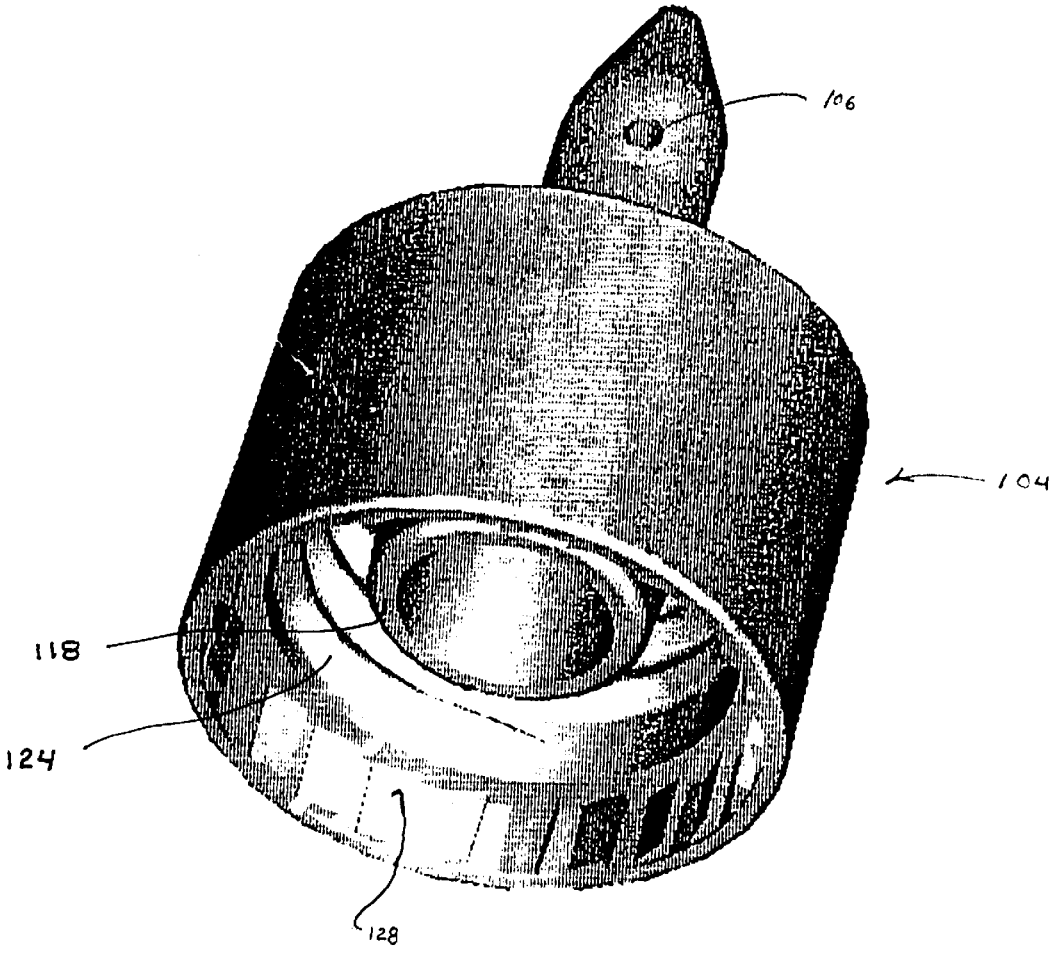
FIG. 3 is a perspective drawing of a seat in accordance with an aspect of the invention
Figure 4B:
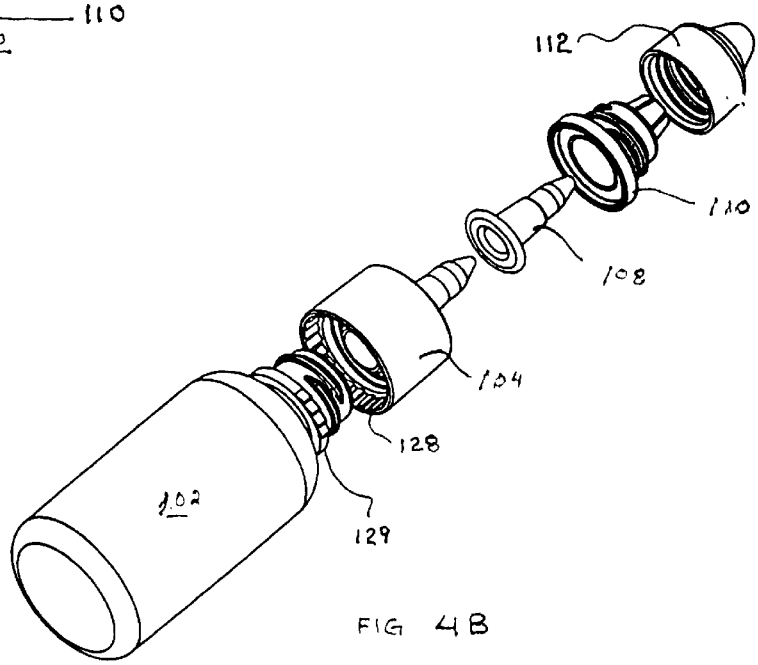
FIG. 4B is a perspective drawing of the components of a valve assembly in accordance with an aspect of the invention.

As shown in FIG. 2, an aspect of the invention shows an elongated, tapered seat 104 with a dispensing or exit port 106 in the side. The base of the seat has a first downwardly projecting annular portion or surface 118, which forms a sealing engagement with the interior surface 120 of the neck of the flexible container 102. The base of the seat 104 has a second downwardly projecting annular portion or surface 122 provided with a means for sealing engagement with the exterior surface of the neck of the container. A series of threads 124 provide sealing interengagement with one or more conformably placed threads 126 on the exterior surface of the neck of the flexible container 102. However, the means for sealing engagement also can comprise a locking ratchet mechanism 128 as shown in FIG. 3, which positively engages a congruent series of ratchet projections 129 on the neck 105 of container 102 as shown in FIG. 4B.

Referring to FIG. 2, the base of the seat 104 also has a shoulder portion 130 linking the first and second downwardly projecting annular portions or surfaces 118 and 122, respectively, such that the seat 110 also sits on top of and in sealing engagement with the top surface 132 of the neck 105 of the container 102. Thus, two side surfaces 118, 122 and the shoulder 130 of the seat sealably engage the neck of the container. This design provides a primary sealing surface 132 at the neck of a container and secondary sealing surfaces on the interior and exterior surfaces of the neck 105 of container 102. The threaded engagement between the seat 104 and the neck 105 of container 102 enables the seat 104 to provide a complete seal with a container over a relatively wide range of tolerances, which one would expect with high volume production of blow molded containers. In accordance with an aspect of the invention, the seat provides a substantially impermeable fail-safe seal around both the interior and outer surfaces of the neck of a container without regard to the existence of flashing, differing tolerances or other non-conformities in the neck of the container.

The seat 104 is tapered over most of its length thereby facilitating ease of assembly of the seal 108 and retainer 110 by snap engagement or press fitting the seal 108 and retainer 110 over the seat. This is particularly advantageous for low cost, high volume assembly. FIGS. 4A and 4B show the assembly of the components. The seat 104 typically comprises a hard plastic material such as an epoxy. High impact machinable epoxies are ideal for durable wear or replacement machine parts and other similar applications. This material is a good substitute in applications where tough plastic parts are used. It is very tough, has high impact resistance and can be molded as the finished part or machined in secondary operations. Variations are available for temperature environments to 400° F.

The seal 108 comprises an elastomeric material, such as silicone, polyurethane and C-flex, which is press fit over the seat 104. Polyurethane is a preferred material, since it is one of the toughest, most abrasion resistant, engineered elastomers available. It outperforms all other rubber type materials in mechanically abusive environments. It can be manufactured to have a durometer as high as 90 Shore D. Aliphatic polyurethane is also water, UV and ozone resistant. This material is ideal for continuous use in a harsh environment.

The seal also can comprise a silicone material. Silicones provide a non-stick surface for many processes. FDA approved and class VI medical materials are available. Silicones maintain their flexibility at low temperature. They have low compression set, and outstanding resistance to high temperature, sunlight, oxidation, ozonolysis, and corrosion. Standard silicones are temperature rated from −1500° F. to 650° F. High performance silicones can operate in a continuous environment from −150° F. to 650° F. with excursions to 850° F.

The seal 108 is provided with an annular base 140, that conformably engages against the base of seat 104. The sides of the seal 108 between its base 140 and the seat exit port 106 are much thicker than the upper portion of the seal 108 above the exit port 106. This configuration delivers a constant compressive force against the portion of the seat below exit port 106 in spite of changes in temperature, pressure, or normal seal wear.

The flexibility of the seal material enables it to conform to mating surfaces of the seat, thereby forming a complete seal closing off the flow of fluid between the seal and seat except when the valve is in the open state. The seal 108 is constructed to be thinner and sharply tapered above the exit port 106. The thickness of the seal at this point is selected to determine a desirable cracking pressure for enabling the fluid to flow out of the exit port and along the tapered tip of the seat when the desired pressure is applied to the walls of the flexible container to dispense the fluid.

The seal 108 and seat 104 are produced from molds. The molds are machined in a circular lay pattern to a surface smoothness equivalent to the smoothness of diamond. Asperities and nonconformities on the mold surface, which form the sealing surfaces of the seal and seat are limited to a range of 0 to 30 microinches and preferably to a range of 0 to 5 microinches. The mold is formed such that there are no parting lines in the parts of the mold that form the sealing surfaces of the seal and seat. Thus, the asperities or imperfections in the sealing surfaces of the seal and seat are limited to the foregoing ranges also.

A retainer 110 is press-fit over the seal 108 and seat 104. The retainer 110 holds the seal 108 in place against the seat 104 and applies a strong compressive force against the sides and base of the seal 108 and seat 104 to effect a positive, impact proof seal between the seal 108 and seat 104 when the cap 112 is threaded in the seated or closed position. The seal thus produced is effectively impermeable and is temperature and pressure invariant.

The retainer 110 is provided with a series of threads 142 on its outer surface for engaging with the congruent interior threads 144 of the cap 112. The seating of cap 112 provides a strong compressive force, through an interior shelf 151, against the sides of the retainer 110 and a downward compressive force by interior shelf 152 at shoulder 150 of the retainer. The threading action of the cap causes the application of strong lateral forces to compress the sides and upper portion of the retainer 110 strongly against the seal 108.

The retainer 110 includes a base portion 146 for conformably holding and fitting over the base 140 of the seal. The base 146 of the retainer 110 is also held in place by an annular rim 148 of the seat 104 as shown in FIG. 2. The retainer 110 comprises any suitable resilient, compressible plastic material that can absorb and transfer compressive forces applied by seating the cap. The retainer holds together the seal and seat in a substantially invariant alignment and translates the compressive forces applied by the cap against the seal and seat to provide a shockproof, leakproof seal when the cap is threaded in place. The substantially smooth sealing surface formed between the seal and seat (each having surface asperities limited to a range of preferably 0 to 5 micro-inches) provides substantially a monolayer of fluid between the sealing surfaces, which prevents the motility of microorganisms and is effective against the intrusion of airborne contaminants and air. The retainer 110 also includes a shoulder portion 150 for conformably engaging an interior shelf 152 of cap 112. The interior shelf 151 comprises a convex annular surface provided on the interior circumference of the cap 112 for engagement against the segments 116 of the retainer when the cap approaches the last quarter turn in the act of being threaded onto the retainer. The convex annular surface provided in the cap compresses the segments 116 of the retainer to provide a complete seal which is shockproof, leakproof, evaporation proof and resistant to changes in temperature and pressure.

The interior shelf 152 transfers a downward compressive force to the base 140 of the seal when the cap 112 is in the seated position. The retainer 110 is provided with a projection of excess material 154 for conformable fit engagement with a congruent depression of the seat 104 for snap engagement for press fitting. The retainer also can be ultrasonically bonded to the seat at projection 154. The seat, seal and retainer also can be heat-sealed.

The projection 154 comprises a point of excess material in the base of the retainer 110. Projection 154 acts as an energy director that is receptive to ultrasonic heating. When ultrasonically heated to its melting point, projection 154 provides a material flow between the adjacent surfaces of the shoulder portion 146 and rim 148 of the seat 104 to form an airtight seal between the retainer 110 and seat 104.

In a preferred mode of assembly, as shown in FIGS. 4A and 4B, the seal is press fit over the seat. The retainer is then ultrasonically bonded to the seat.

As shown in FIGS. 2, 4A and 4B, the taper of the seat 104 increases substantially above the exit port 106. This angle enables progressive excursion of fluid away from the exit port 106 when the retainer 110 and tapered portion of the seal 108 apply compressive forces against the seat 104. The taper of the seat is optimized to provide a droplet of desired volume at a distal end of the seat body.

Referring to FIGS. 4A and 4B, retainer 110 includes a plurality of segments 116 separated by spaces which are necessary to accommodate the taper of the seat 104 and enable flexion of each of the segments 116. As the cap is seated, the segments 116 are compressed together to provide a progressive seal for the excursion of fluid in a downstream direction away from exit port 106 in response to the seating of the cap 112.

In operation, the compressive force exerted by the retainer 110 against the seal 108 locks the seal 108 strongly against the mating surfaces of the seat 104 and insures a positive seal. When the cap 112 is seated onto the retainer 110, the retainer 110 transmits the compressive forces applied by the seated cap 112 to all sealing surfaces to insure consistent sealing of the container 102 against evaporation, backflow and leakage due to vibration as well as changes in temperature and pressure. The tapered configuration of the seat 104 interacts with the seal 108 and retainer 110 to create a progressive seal for the excursion of fluid in a downstream direction away from the exit port upon closure and restricts the backflow of excess fluid and environmental contaminants. The retainer 110 transmits the pressure of the seated cap to all sealing surfaces to insure consistent sealing of the container against evaporation, backflow and leakage due to vibration as well as changes in temperature and pressure.

FIG. 2 shows the cap 112 installed, the retainer 110 compressed to form a locking seal between seal 108 and seat 104 under pressure. As the engagement of the threaded cap 112 increases the compressive forces applied to the retainer 110, the retainer moves conformably against the seal 108.

To dispense the fluid, the cap is removed and pressure is applied to the walls of the container 102. The amount of cracking pressure required to move the seal off of the seat at the exit port 106 is determined by the frictional force of the seal on the sealing surfaces and the durometer and modulus of elasticity of the seal material. The seal material can be engineered by well-known techniques to have a cracking pressure that is optimal for the particular viscosity of the contained fluid.

When the internal pressure in the container 102 exceeds the frictional forces between the seal 108 and seat 104 at the exit port 106, the fluid is directed downstream along the tapered end of the seat 104. When the internal pressure in container 102 is released, the compressive force applied by the seal 108 against the tapered end of the seat 104 will progressively form a seal tight engagement between the seal 108 and seat 104. The cap 112, acting in combination with the retainer 110, seal 108 and seat 104 provides a compression seal, preventing migration of liquids, gases or solid contaminants, whether by diffusion, osmosis, or motility of microbes, or combinations of these, inanimate or animate, across the sealing surface formed between the seal 108 and seat 104.

The flexibility of the seal material enables the seal 108 to conform to mating surfaces of the seat 104, thereby closing off the flow of fluid. The retainer 110 transmits the pressure of the seated cap 112 to all sealing surfaces of the seal 108 and seat 104 to insure consistent sealing of the container.

The compressive force exerted against the seal 108 by the retainer 110 on the mating surfaces insures a positive seal, even against vibration as well as against changes in temperature and pressure so as to maintain the integrity of the remaining fluid by preventing the entry of environmental contaminants.

Under high pressure, the seal 108 functions as a time-gate that closes progressively, initially at the exit port 106 and then continues sequentially in the downstream direction, to move excess fluid and foreign matter away from the exit port 106. The seal 108, seat 104 and retainer 110 interact to create a reusable compression seal. This provides a means for preventing migration of gas, liquid, or solid contaminants across the compression seal at the exit port 106 or opening in the seat 104. The compression seal not only prevents the escape of fluid from the inside and entry of foreign from the outside, but it also provides a substantially impermeable seal for multiple reversible cycles of dispensing the fluid, by fastening and removing the cap 112.

The seat 104 seals the interior, exterior and top surfaces of the neck of the container 102. The material for the seat is chosen to be compatible with the material comprising the neck of the container. For example, if the neck of the container is plastic, one chooses a compatible plastic for the seat that enables a strong compression fit between the seat 104 and the neck of the container 105. The threads 126 on the neck of the container 105 effect a compressive force to form the primary seal 132 between the seat 104 and the top of the container 102 as the seat 104 is threaded onto the neck of the container 105. The threading action also effects a strong secondary seal between the seat 104 and the interior 120 and exterior 126 surfaces of the neck 105 of the container 102. For additional protection, these threads can be designed as a one-way ratchet thereby providing a tamper-proof or tamper-evident benefit. For example, if the ratcheted threads 128 on the seat 104 are engaged by clockwise rotation with the ratchet projections 129 on the neck 105 of the container 102, as shown in FIG. 4B, attempts to disengage the threaded parts by counterclockwise rotation may prove impossible without stripping the threads. The presence of stripped threads will provide evidence that someone has tampered with the delivery system.

The cap 112, retainer 110, seal 108 and seat 104 thus form a modular valve assembly that prevents the escape of fluid from inside and the entry of foreign matter into the system from the outside. By using a combination of snapping, press fitting or screwing operations, the four parts can be assembled and then easily integrated into a variety of containers. The modular valve assembly closure is designed to provide particular sealing benefits for containers that may have a relatively wide range of neck tolerances, such as those produced in bulk quantities or by co-blow molding operations.

Figure 5:
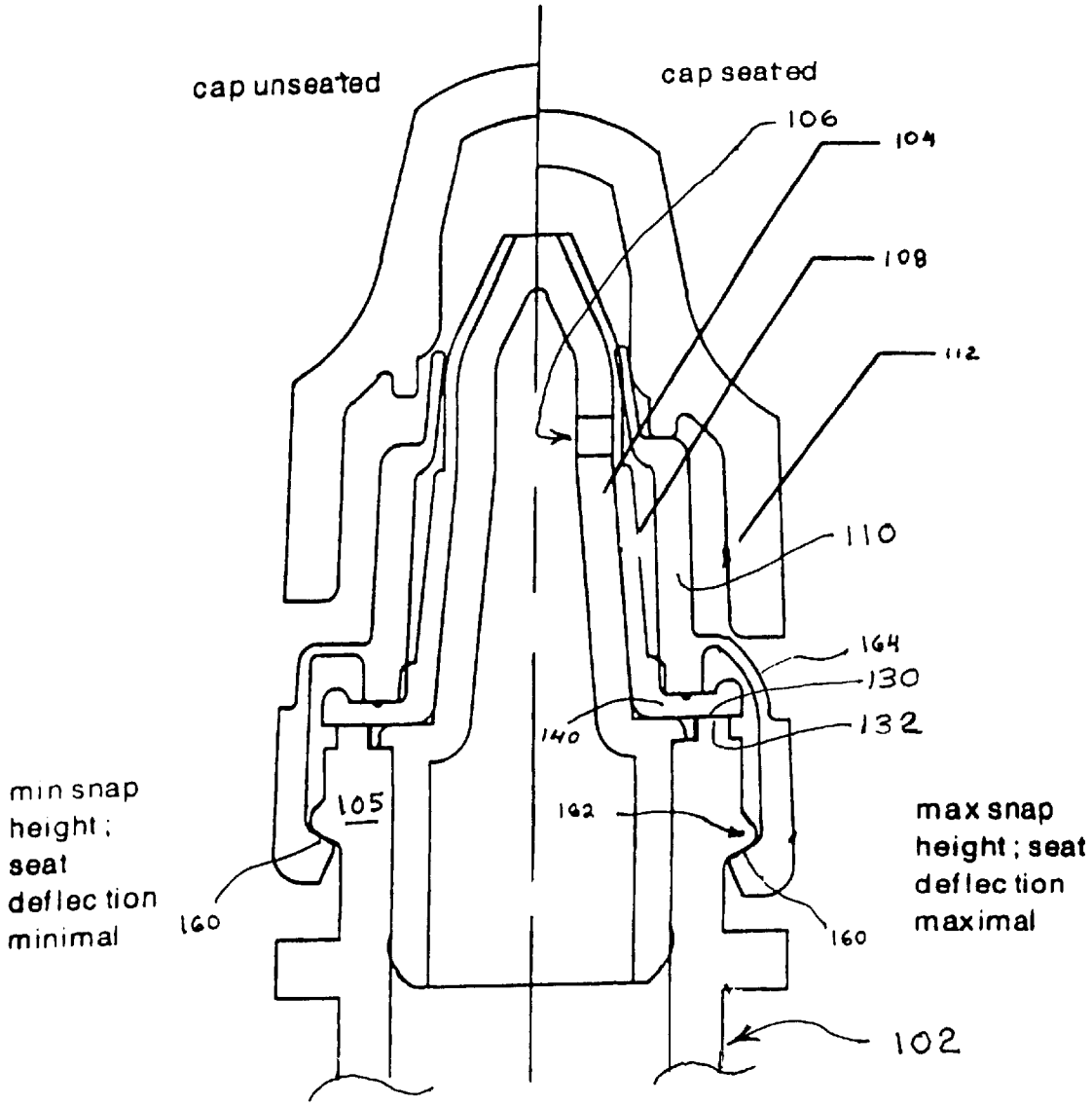
FIG. 5 is a cross-sectional diagram of an alternative embodiment of the valve assembly, with the cap in both an unseated and a seated position, in accordance with an aspect of the invention.

FIG. 5 shows an alternate embodiment of a valve assembly. A retainer 110 includes an annular projecting surface 160 on its base for conformable snap engagement with a congruent annular projection 162 provided on the exterior surface of the neck of container 102. In this embodiment, retainer 110 also includes a resilient spring like portion 164 that expands to enable snap engagement of the annular surface 160 of the container against annular projection 162 of the cap. Once the retainer is engaged on the cap, portion 164 applies a compressive force downward against the base 140 of seal 108 that seals the top surface 132 of the neck 105 of container 102 and shoulder portion 130 of seat 104.

In accordance with an aspect of the invention, a container manufacturer or provider of a fluid material can attach the valve assembly to a container as the last step in a filling line. This allows for minimal or no filling line changes by the manufacturer. In addition, the valve assembly provides a maximum seal that can be used with blow molded containers or any product where manufacturing tolerances cannot be maintained within a tight range. The seal provided by the valve assembly is essentially airtight, shockproof, leakproof, evaporation proof and immune to variations in temperature and pressure. Therefore, the valve assembly enables ease of transport and long-term storage of fluids without contamination or changes in volume and concentration.

While the invention has been described in connection with what is presently considered to be the most practical and preferred embodiments, it is to be understood that the invention is not limited to the enclosed embodiments, but on the contrary is intended to cover various modifications and equivalent arrangements included within the spirit and scope of the appended claims. For example, the retainer does not need to be threaded to the neck of a container. The retainer may be provided with a flexible portion for snap engagement with a rim on the neck of a container. Other appropriate anchoring mechanisms can be used. Therefore, persons of ordinary skill in this field are to understand that all such equivalent structures are to be included within the scope of the following claims.

We claim:

1. An airtight, shockproof valve assembly for engagement in the neck of a compressible or volumetrically reducible container of a flowable medium and for providing an invariant seal of the sealing surfaces, wherein the valve assembly is effective against vibration, temperature, pressure, evaporation and unintentional ingress or egress of matter, said valve assembly comprising:

a tapered seat defining a flow path to an exit port for fluid residing in the container, the seat comprising: a U shaped base having a first surface extending for sealing contact with an interior surface of the neck; a second surface for locking engagement with an exterior surface of the neck; and a shoulder portion connecting said first and second surfaces for sealing a top surface of the neck;

the base of said seat further comprising an upwardly extending rim for holding a retainer;

an elastomeric seal substantially coextensive with the tapered portion of the seat for moveable sealing engagement against the seat for sealing the exit port of said seat against flow when the atmospheric pressure is equal to or greater than the pressure in the container;

a retainer having a base including a peripheral surface for engagement against the inner surface of the rim of the seat and having an engagement surface extending upwardly from the retainer base for repeatable locking engagement with a cap;

said retainer further comprising one or more segments extending distally from the engagement surface wherein said segments progressively close and are compressed against the seal upon locking engagement of the retainer with the cap, such that the seal is held in conformable engagement against the seat providing an invariant airtight, leakproof seal between the seal and seat, which is effective against vibration, temperature, pressure, evaporation, and unintentional ingress or egress of matter.

2. An airtight, shockproof, leakproof and evaporation proof valve assembly as in claim 1 wherein the retainer base further comprises a first surface for locking the base of the seal against a base of the seat, and a second surface for engagement against an interior surface of said rim of the seat, and a third surface for contacting an adjacent surface of the base of the seat, said third surface of the retainer including a point of excess material for providing a sonic welding melt for material flow between the contacting surfaces of the retainer base and seat.

3. An airtight, shockproof, leakproof and evaporation proof valve assembly as in claim 1 further comprising a cap having a series of threads for threaded engagement with a corresponding threaded surface of the retainer for applying a strong compressive force for closing the retainer segments tightly against the seal, the cap including a shoulder portion disposed upwardly from the threads for providing a laterally compressive force and a downward locking force against the retainer and seal for invariantly locking the seal against the seat.

4. An airtight, shockproof, leakproof and evaporation proof valve assembly as in claim 1 further comprising a cap having an interior surface provided with means for repeatable snap engagement with said corresponding engagement surface of the retainer for applying a strong compressive force for closing the retainer segments tightly against the seal, the cap including a shoulder portion disposed upwardly from the threads for providing a laterally compressive force and a downward locking force against the retainer and seal for invariantly locking the seal against the seat.

5. An airtight, shockproof, leakproof and evaporation proof valve assembly as in claim 1, wherein the first surface and shoulder portion of the base of the seat form an airtight seal with the interior surface and top surface of the container neck, irrespective of disparities in manufacturing tolerances of the neck of the container.

6. An airtight, shockproof, leakproof and evaporation proof valve assembly as in claim 1 wherein the point of excess material in the base of the retainer comprises an energy director which is receptive to ultrasonic heating to a melting point for providing a material flow between the adjacent surfaces of the retainer base and rim of the seat to form an airtight seal between the retainer and seat.

7. An airtight, shockproof, leakproof and evaporation proof valve assembly effective against vibration, evaporation, changes in temperature, pressure, and enabling the maintenance of sterility, including a seat, seal, and segmented retainer responsive to compressive force applied by a cap for locking the seal against the seat and for providing an airtight seal to the interior, exterior and top surfaces of a flexible container over a wide range of tolerances irrespective of the presence of flash or other nonconformities on the container comprising;

a seat having a tapered body for defining a flow path including an orifice for dispensing a flowable medium held in the container, the seat further comprising a base extending outwardly from the body culminating in a peripheral rim, said base comprising a top surface extending to said rim, a bottom surface having a first downwardly extending leg for sealing engagement with the interior surface of the container, a second downwardly extending leg including a series of threads for engagement with one or more corresponding threads on the outer surface of the container, and a shoulder portion joining the first and second legs for sealing engagement with the top of the container;

a tapered elastomeric seal substantially coextensive with the seat for sealing engagement against all but the distal portion of the seat, the seal enabling outflow of the flowable medium upon application of a sufficient cracking pressure to the flowable medium upon removal of the cap;

a retainer for holding the seal in place against the seat, said retainer having a tapered portion divided into a plurality of segments for moveable engagement against the seal, a central portion having an interior surface for holding the seal against the seat and an exterior surface provided with engagement means for snap engagement with the cap, and a base having a first potion for engagement against the peripheral rim of the seat, a second portion for engagement against the top surface of the base of the seat and a third portion for locking the base of the seal to the base of the seat;

a cap for seating engagement with the retainer for providing a strong compressive force to close the segments of the retainer against the seal to form an airtight seal against the seat which is impervious to vibration, temperature and changes in differential pressure when the cap is seated.

8. An airtight, shockproof, leakproof and evaporation proof valve assembly as in claim 6 wherein the taper of the seat is optimized to provide a droplet of desired volume at a distal end of the seat body.

9. An airtight, shockproof, leakproof and evaporation proof valve assembly as in claim 6, wherein the threaded portion of the base of the seat is fitted with a locking ratchet for invariantly engaging the valve assembly in an airtight seal with the container.

10. An airtight, shockproof, leakproof and evaporation proof valve assembly as in claim 6, wherein the strain between the seal and seat is optimized for ease of opening the valve when the cap is disengaged.

11. An airtight, shockproof, leakproof and evaporation proof valve assembly system capable of extending the useful life of a fluid contained in a volumetrically reducible or compressible container to the fluid's shelf life, for maintaining the sterility and integrity of the fluid against evaporation, vibration, temperature, pressure, and unintentional ingress and egress of matter, said valve assembly system comprising:

a volumetrically reducible or compressible container, serving as a fluid reservoir, having a neck for attachment to the valve assembly;

a tapered seat defining a flow path to an exit port for the contained fluid, the seat comprising: a U shaped base having a first surface extending for sealing contact with an interior surface of the neck; a second surface for locking engagement with an exterior surface of the neck; and a shoulder portion connecting said first and second surfaces for sealing a top surface of the neck;

the base of said seat further comprising an upwardly extending rim for holding a retainer;

an elastomeric seal substantially coextensive with the tapered portion of the seat for moveable sealing engagement against the seat for sealing the exit port of said seat against flow when the atmospheric pressure is equal or greater than the pressure in the container;

a retainer having a base including a peripheral surface for engagement against the inner surface of the rim of the seat and having an engagement surface extending upwardly from the retainer base for repeatable locking engagement with a cap;

said retainer further comprising one or more segments extending distally from the engagement surface wherein said segments progressively close and are compressed against the seal upon locking engagement of the retainer with the cap, such that the seal is held in conformable engagement against the seat providing an invariant airtight, leakproof seal between the seal and seat which is effective against vibration, temperature, pressure, evaporation, unintentional ingress or egress of matter, and extends the useful life of that fluid in the container to its shelf life, so that during use, the container behaves as though it has never been opened.

* * * * *